US007164225B2

(12) United States Patent
Yoshimoto et al.

(10) Patent No.: US 7,164,225 B2
(45) Date of Patent: Jan. 16, 2007

(54) SMALL SIZE SPARK PLUG HAVING SIDE SPARK PREVENTION

(75) Inventors: Osamu Yoshimoto, Nagoya (JP); Wataru Matsutani, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/937,432

(22) Filed: Sep. 10, 2004

(65) Prior Publication Data

US 2005/0057135 A1 Mar. 17, 2005

(30) Foreign Application Priority Data

Sep. 11, 2003 (JP) ..... P.2003-319904

(51) Int. Cl.
*H01T 13/20* (2006.01)

(52) U.S. Cl. ..... 313/141; 313/143

(58) Field of Classification Search ..... 123/169 R, 123/E1; 313/118–145
See application file for complete search history.

(56) References Cited

U.S. PATENT DOCUMENTS 4,795,944 A * 1/1989 Stimson ..... 315/71
6,147,441 A 11/2000 Osamura
6,528,929 B1 * 3/2003 Matsutani et al. ..... 313/141
6,611,084 B1 * 8/2003 Teramura et al. ..... 313/141
6,680,561 B1 * 1/2004 Yamaguchi et al. ..... 313/118
6,724,133 B1 * 4/2004 Miyashita et al. ..... 313/143
2004/0027042 A1 * 2/2004 Matsutani et al. ..... 313/141

FOREIGN PATENT DOCUMENTS

EP 09-219274 8/1997
JP 2000-243535 9/2000

* cited by examiner

*Primary Examiner*—Joseph Williams
*Assistant Examiner*—Bumsuk Won
(74) *Attorney, Agent, or Firm*—Sughrue Mion, PLLC

(57) ABSTRACT

A spark plug including an insulator having an axial hole in an axial direction; and a center electrode disposed in a tip end side of the axial hole of the insulator so as to project a tip end of the center electrode from the tip end side of the insulator. The center electrode includes an electrode base member made of pure Ni or an Ni alloy containing 85 wt % or more of Ni; and a noble metal chip fixed to a tip end of the electrode base. The spark plug further includes a metal shell surrounding the insulator; and a ground electrode in which one end is joined to the metal shell, and another end portion opposes the noble metal chip to form a spark discharge gap between the ground electrode and noble metal chip, wherein M, D1, and D2 as defined herein satisfy M≦10.1 mm, 0.5 mm≦D2<1.4 mm, and D1/D2≧3.5.

20 Claims, 6 Drawing Sheets

SMALL SIZE SPARK PLUG HAVING SIDE SPARK PREVENTION

BACKGROUND OF THE INVENTION

1. Field of the Invention

The present invention relates to a spark plug used for providing ignition of an internal combustion engine.

2. Description of the Related Art

As a spark plug used for providing ignition of an internal combustion engine such as an automotive engine, many spark plugs of the type in which a noble metal chip consisting primarily of Pt, Ir, or the like is welded to a tip end of an electrode have been proposed. This configuration is employed because a discharge portion of the spark plug is arranged so as to protrude into a combustion chamber in order to enhance ignitability of the spark plug, and hence the discharge portion is exposed to a high temperature.

Recently, engine heads tend to have a complicated structure, and a space which is in the vicinity of a valve, and in which a spark plug is to be mounted, is reduced. Therefore, there is an increasing demand for a small spark plug in which the outer diameter of a fitting thread portion of a metal shell is reduced to 12 mm or smaller. When the inner diameter of a metal shell is reduced, the distance between the side face of a center electrode protruding from an insulator, and the inner face of the metal shell is shorter than in a conventional spark plug. A problem thereby arises in that so-called side discharge in which a spark is generated between the center electrode and the metal shell easily occurs. When such a side discharge occurs, spark discharge is not generated in the spark discharge gap, thereby adversely affecting ignitability. In order to prevent side discharge, various techniques have been proposed.

In the spark plug of JP-A-2000-243535, it has been found that, in the configuration in which the discharge portion is made of a refractory noble metal chip, wear of the discharge portion does not largely advance even when the heat dissipation property of the center electrode is somewhat impaired by reducing the diameter of the center electrode. Therefore, the distance between the side face of the center electrode and the inner face of the metal shell is sufficiently ensured by reducing the diameter of the center electrode, whereby the occurrence of side discharge is reduced.

In order to further enhance output and improve fuel consumption, newer internal combustion engines require an increase in temperature and pressure in the combustion chamber, and must allow for ignition of a lean fuel mixture. In the spark plug of JP-A-2000-243535, however, there is a possibility that side discharge cannot be sufficiently eliminated under these conditions.

SUMMARY OF THE INVENTION

It is therefore an object of the present invention to provide a spark plug employing a noble metal chip in a discharge portion thereof a fitting thread portion having an outer diameter of 12 mm or smaller, and which can prevent a side spark from occurring, having a small size, and providing excellent ignitability.

The above object of the present invention has been achieved by providing a spark plug, which comprises:

an insulator having an axial hole in an axial direction of the spark plug;

a center electrode disposed in a tip end side of the axial hole of the insulator so as to project a tip end of the center electrode from the tip end side of the insulator, the center electrode having; an electrode base member which is made of pure Ni or an Ni alloy containing 85 wt % or more of Ni; and a noble metal chip fixed to a tip end of the electrode base member;

a metal shell surrounding the insulator; and a ground electrode in which one end is joined to the metal shell, and another end portion opposes the noble metal chip to form a spark discharge gap between the ground electrode and the noble metal chip, and when an outer diameter of a tip end of the metal shell is M, an inner diameter of the tip end of the metal shell is D1, and an outer diameter of the center electrode in a virtual plane containing a tip end of the insulator is D2, the following relationships are satisfied:

$$M \leqq 10.1 \text{ mm},$$

$$0.5 \text{ mm} \leqq D2 < 1.4 \text{ mm, and}$$

$$D1/D2 \geqq 3.5.$$

In the case of a spark plug in which the tip end outer diameter M of the metal shell is 10.1 mm or smaller (corresponding to the thread diameter M12), the distance between the side face of the center electrode and the inner face of the metal shell is smaller than that of a conventional spark plug (a spark plug in which the tip end outer diameter M is larger than 10.1 mm), and hence side discharge may possibly occur between the center electrode and the metal shell. Therefore, the spark plug of the invention is structured so that, when the inner diameter of the tip end face of the metal shell is D1, and the outer diameter of the center electrode in a virtual plane containing the tip end of the insulator is D2, the relationship D1/D2≧3.5 is attained. According to this configuration, the distance between the side face of the center electrode and the inner face of the metal shell can be sufficiently ensured, and side discharge between the center electrode and the metal shell can be suppressed. When D1/D2<3.5, the distance between the side face of the center electrode and the inner face of the metal shell cannot be sufficiently ensured, and side discharge can possibly occur between the center electrode and the metal shell. More preferably, the relationship D1/D2≧5.0 is set.

The tip end outer diameter M of the metal shell means the outer diameter of the tip end excluding a chamfered portion formed in the edge of the tip end of the metal shell (i.e., the chamfered portion is not subtracted from M). The invention can also be applied to a so-called threadless plug in which a fitting thread portion is not formed in the outer side face of the metal shell.

In a spark plug in which the tip end outer diameter M of the metal shell is 10.1 mm or smaller, in order to form a structure where D1/D2≧3.5, it is preferable to set 0.5 mm≦D2<1.4 mm where D2 is the outer diameter of the center electrode in a virtual plane containing the tip end of the insulator. When D2 is set in this way, the relationship D1/D2≧3.5 can be easily attained while setting the tip end outer diameter M of the metal shell to 10.1 mm or smaller.

Also in the spark plug of JP-A-2000-243535, as in the invention, the discharge portion is proposed to be configured by a noble metal chip and the diameter of the center electrode is reduced, whereby the distance between the side face of the center electrode and the inner face of the metal shell can be sufficiently ensured so that side discharge between the center electrode and the metal shell can be suppressed. In the spark plug of JP-A-2000-243535, however, the heat dissipation property of the center electrode due to reduction of the diameter of the center electrode is not considered. In a situation where side discharge easily occurs when further raising the temperature and the pressure, therefore, it is difficult to simply reduce the diameter of the center electrode. By contrast, in the spark plug of the invention, the center electrode is configured by: an electrode base member which is made of pure Ni or an Ni alloy containing 85 wt % or more of Ni; and the noble metal chip is fixed to the tip end of the electrode base member. Since a noble metal chip is disposed on the tip end of the center electrode and pure Ni or an Ni alloy containing 85 wt % or more of Ni is used as the electrode base member, the heat resistance of the center electrode is ensured, and wear of the discharge portion is suppressed. Therefore, the outer diameter D2 of the center electrode in a virtual plane containing the tip end of the insulator can be set to 0.5 mm≦D2<1.4 mm as described above, and side discharge can be suppressed.

When the center electrode has an electrode base member made of an Ni alloy containing Ni in an amount of less than 85 wt %, the heat resistance of the center electrode is not sufficiently ensured, and hence the effect of suppressing wear of the discharge portion cannot be attained.

In a second embodiment, the spark plug of the present invention comprises:

an insulator having an axial hole in an axial direction of the spark plug, a center electrode disposed in a tip end side of the axial hole of the insulator to project a tip end of the center electrode from the tip end side of the insulator, the center electrode having: an electrode base member, and a noble metal chip fixed to a tip end of the electrode base member;

a metal shell surrounding the insulator; and a ground electrode in which one end is joined to the metal shell, and another end portion opposes the noble metal chip to form a spark discharge gap between the ground electrode and the noble metal chip, wherein the electrode base member is formed by: a core disposed inside the electrode base member, the core containing 90 wt % or more of a metal, the metal when pure having a thermal conductivity of 90 W·mK or more; and a skin layer which surrounds the core, and wherein a film thickness at a tip end of the insulator is 5 μm or more, the skin layer being made of pure Ni or an Ni alloy having a thermal conductivity lower than that of the core, and when an outer diameter of a tip end of the metal shell is M, an inner diameter of the tip end of the metal shell is D1, and an outer diameter of the center electrode in a virtual plane containing the tip end of the insulator is D2, the following relationships are satisfied.

M≦10.1 mm, 0.5 mm≦D2<1.4 mm, and

D1/D2≧3.5.

In the case of a spark plug in which the tip end outer diameter M of the metal shell is 10.1 mm or smaller (corresponding to the thread diameter M12), the distance between the side face of the center electrode and the inner face of the metal shell is smaller than that of a conventional spark plug (a spark plug in which the tip end outer diameter M is larger than 10.1 mm), and hence side discharge possibly occurs between the center electrode and the metal shell. Therefore, the spark plug of the invention is structured so that, when the inner diameter of the tip end face of the metal shell is D1, and the outer diameter of the center electrode in a virtual plane containing the tip end of the insulator is D2, the relationship D1/D2≧3.5 is attained. According to this configuration, the distance between the side face of the center electrode and the inner face of the metal shell can be sufficiently ensured, and side discharge between the center electrode and the metal shell can be suppressed. When D1/D2<3.5, the distance between the side face of the center electrode and the inner face of the metal shell cannot be sufficiently ensured, and side spark discharge can possibly occur between the center electrode and the metal shell. More preferably, the relationship D1/D2≧5.0 is set.

In a spark plug in which the tip end outer diameter M of the metal shell is 10.1 mm or smaller, in order to form a structure where D1/D2≧3.5, it is preferable to set 0.5 mm≦D2<1.4 mm where D2 is the outer diameter of the center electrode in a virtual plane containing the tip end of the insulator. When D2 is set in this way, D1/D2≧3.5 can be easily attained while setting the tip end outer diameter M of the metal shell to be 10.1 mm or smaller.

Also in the spark plug of JP-A-2000-243535, as in the invention, the discharge portion is proposed to be configured by a noble metal chip and the diameter of the center electrode is reduced, whereby the distance between the side face of the center electrode and the inner face of the metal shell can be sufficiently ensured so that side discharge between the center electrode and the metal shell can be suppressed. In the spark plug of JP-A-2000-243535, however, the heat dissipation property of the center electrode due to reduction of the diameter of the center electrode is not considered. In a situation where side discharge easily occurs when further raising the temperature and the pressure, it is difficult to simply reduce the diameter of the center electrode. By contrast, in the spark plug of the invention, the center electrode has an electrode base member formed by: a core which is disposed inside the electrode base member, the core containing 90 wt % or more of a metal, the metal when pure having a thermal conductivity of 90 W·mK or more; and a skin layer which surrounds the core, and wherein a film thickness at the tip end of the insulator is 5 μm or more, the skin layer being made of a pure Ni or an Ni alloy having a thermal conductivity smaller than that of the core; and the noble metal chip is fixed to the tip end of the electrode base member. Because a noble metal chip is disposed in the tip end of the center electrode, and the electrode base member is formed by: a core disposed inside the electrode base member and containing 90 wt % or more of a metal the metal when pure having a thermal conductivity of 90 W·mK or more; and the skin layer which surrounds the core, and in which a film thickness at the tip end of the insulator is 5 μm or more, the skin layer being made of a pure Ni or an Ni alloy having a thermal conductivity lower than that of the core, the heat resistance of the center electrode is ensured, and wear of the discharge portion is suppressed. Therefore, the outer diameter D2 of the center electrode in a virtual plane containing the tip end of the insulator can be set to 0.5 mm≦D2<1.4 mm as described above, and side discharge can be suppressed. Thermal conductivities of pure metals are listed in RIKA NENPYO (ver. 2002).

When the film thickness of the skin layer at the tip end of the insulator is smaller than 5 μm, the skin layer is so thin that the core material exhibiting larger expansion breaks the skin material so as to be exposed, and hence the wear resistance of the electrode base member itself is lowered. In the case of an Ni alloy having an Ni content of less than 85 wt %, the thickness of the skin layer is preferably set to 5 to 500 μm. When the thickness is larger than 500 μm, heat resistance cannot be ensured, and wear resistance is lowered.

In the spark plug of the invention, preferably, the tip end of the insulator protrudes from the tip end of the metal shell, or is positioned in a virtual plane containing the tip end of the metal shell, and, when an outer diameter of the insulator in a virtual plane containing a tip end face of the metal shell is D3, the relationship D1/D3>1.8 is set. When the relationship D1/D3>1.8 is set as described above, the gap formed between the outer face of the insulator and the metal shell can be made larger, and side discharge between the center electrode and the metal shell can be further suppressed. When the relationship D1/D3≦1.8 is set, the gap between the outer face of the insulator and the metal shell is excessively small, and the above-mentioned effects cannot be sufficiently attained. Moreover, it is preferable to set D3≧D2+0.1 mm. When the relationship D3<D2+0.1 mm is set, the thickness of the insulator is excessively thin, and hence the insulator has insufficient dielectric strength, thereby producing a problem in that dielectric breakdown and the like easily occurs. More preferably, the relationship D1/D3>2.0 is set.

In the spark plug of the invention, preferably, the tip end of the insulator is positioned on a rear end side with respect to the tip end of the metal shell, and, when an outer diameter of the tip end of the insulator is D4, the relationship D1/D4>1.8 is set. When the relationship D1/D4>1.8 is set as described above, the gap formed between the outer face of the insulator and the metal shell can be made larger, and side discharge between the center electrode and the metal shell can be further suppressed. When the relationship D1/D4≦1.8 is set, the gap between the outer face of the insulator and the metal shell is excessively small, and the above-mentioned effects cannot be sufficiently attained. Moreover, it is preferable to set D4≧D2+0.1 mm. When D4<D2+0.1 mm is set, the thickness of the insulator is excessively thin, and hence the insulator has insufficient dielectric strength, thereby producing a problem in that dielectric breakdown and the like easily occurs. More preferably, the relationship D1/D4>2.0 is set. As shown in FIG. 3, the outer diameter D4 of the tip end of the insulator is a diameter of a virtual line formed by intersection of a virtual plane containing the tip end face of the insulator and a virtual side face which is obtained by extending the side face of the insulator toward the tip end side.

In the spark plug of the invention, the noble metal chip may primarily contain (50 wt % or more) of one of Ir and Pt. Even in an environment where the temperature of the center electrode is easily raised, these metal elements enable the discharge portion to have excellent wear resistance.

In the spark plug of the invention, the noble metal chip may comprise an Ir alloy which mainly (50 wt % or more) contains Ir, and to which one or two or more of Pt, Rh, Ni, Ru, Pd, W, and Re are added. Ir is easily oxidized and volatilized in a high temperature region. In the case where the noble metal chip primarily contains Ir, when Ir is used as is in the discharge portion, therefore, wear due to oxidization or volatilization is more problematic than spark wear. Therefore, the noble metal chip preferably comprises an Ir alloy which mainly contains Ir, and to which one or two or more of W, Pt, Rh, Ni, Ru, Pd, and Re are added, whereby oxidization or volatilization of Ir can be effectively suppressed, to impart excellent wear resistance to the discharge portion.

When the noble metal chip comprises an Ir alloy which mainly contains Ir, and to which Rh is added, it is possible to suppress wear due to oxidization or volatilization and discharge wear, but there is the possibility that abnormal wear occurs in the discharge portion such that the side face of the sparking portion is gauged. When the noble metal chip comprises an Ir alloy which mainly contains Ir, to which Rh is added, and to which Ni is further added, therefore, abnormal wear can be suppressed while suppressing wear due to oxidization or volatilization and discharge wear.

When the noble metal chip is configured based on the above-mentioned Ir alloy, one or two or more of an oxide, a carbide, a nitride, and a boride of one or two or more elements selected from Y, Zr, and La may be added to prevent oxidization and volatilization of Ir. For example, an oxide (including a complex oxide) of one or two or more elements selected from Y, Zr, and La can be contained in a range of 0.1 to 15 wt %. According to this configuration, wear due to oxidization or volatilization of the Ir component can be suppressed more effectively. When the content of the oxide is smaller than 0.1 wt %, the effect of preventing oxidization and volatilization of Ir by addition of the oxide is not sufficiently attained. By contrast, when the content of the oxide is larger than 15 wt %, the theraal shock resistance of the chip is lowered. As a result, defects such as cracks may occur in the case where, for example, the chip is fixed to the electrode by welding or the like. As the oxide, $Y_2O_3$ is preferred. Alternatively, $La_2O_3$, $ZrO_2$, and the like may be preferably used.

In the spark plug of the invention, a chamfered portion is preferably formed in an inner peripheral edge of the tip end of the metal shell. According to this configuration, the distance between the outer diameter of the center electrode and the inner diameter of the tip end face of the metal shell is increased, and side discharge can be further suppressed.

In the spark plug of the invention, a minimum distance in the axial direction between the core of the electrode base member and the noble metal chip is preferably 2 mm or less. According to this configuration, excess heat of the noble metal chip can be effectively transferred to the core of the center electrode, and hence the wear resistance of the noble metal chip is improved.

DESCRIPTION OF REFERENCE NUMERALS AND SYMBOLS

Figure 1:
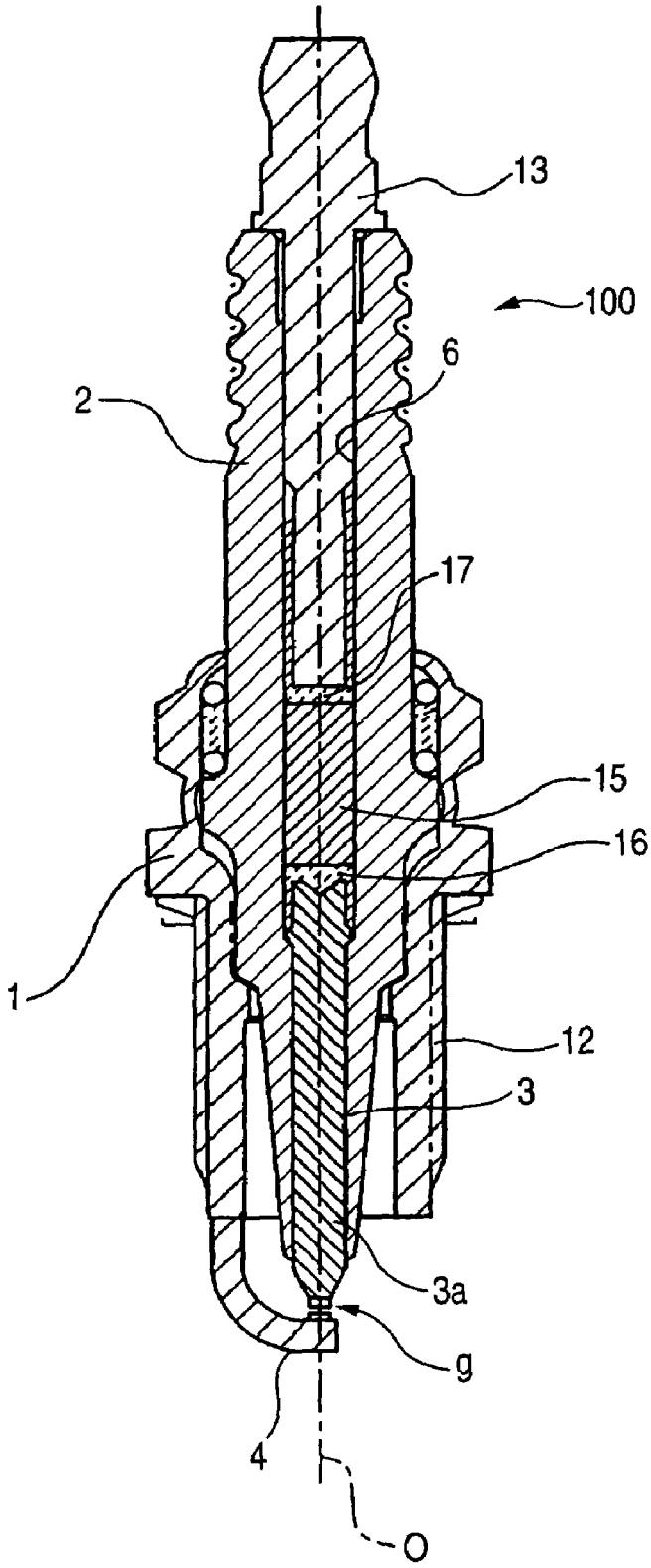
FIG. 1 is a front sectional view showing Embodiment 1 of the spark plug of the invention.

1 metal shell
2 insulator
3 center electrode
4 ground electrode
6 through hole
31 sparking portion (noble metal chip)
100 spark plug

DETAILED DESCRIPTION OF THE INVENTION

Embodiment 1

Hereinafter, several embodiments of the invention will be described with reference to the accompanying drawings. However, the present invention should not be construed as being limited thereto.

Figure 2:
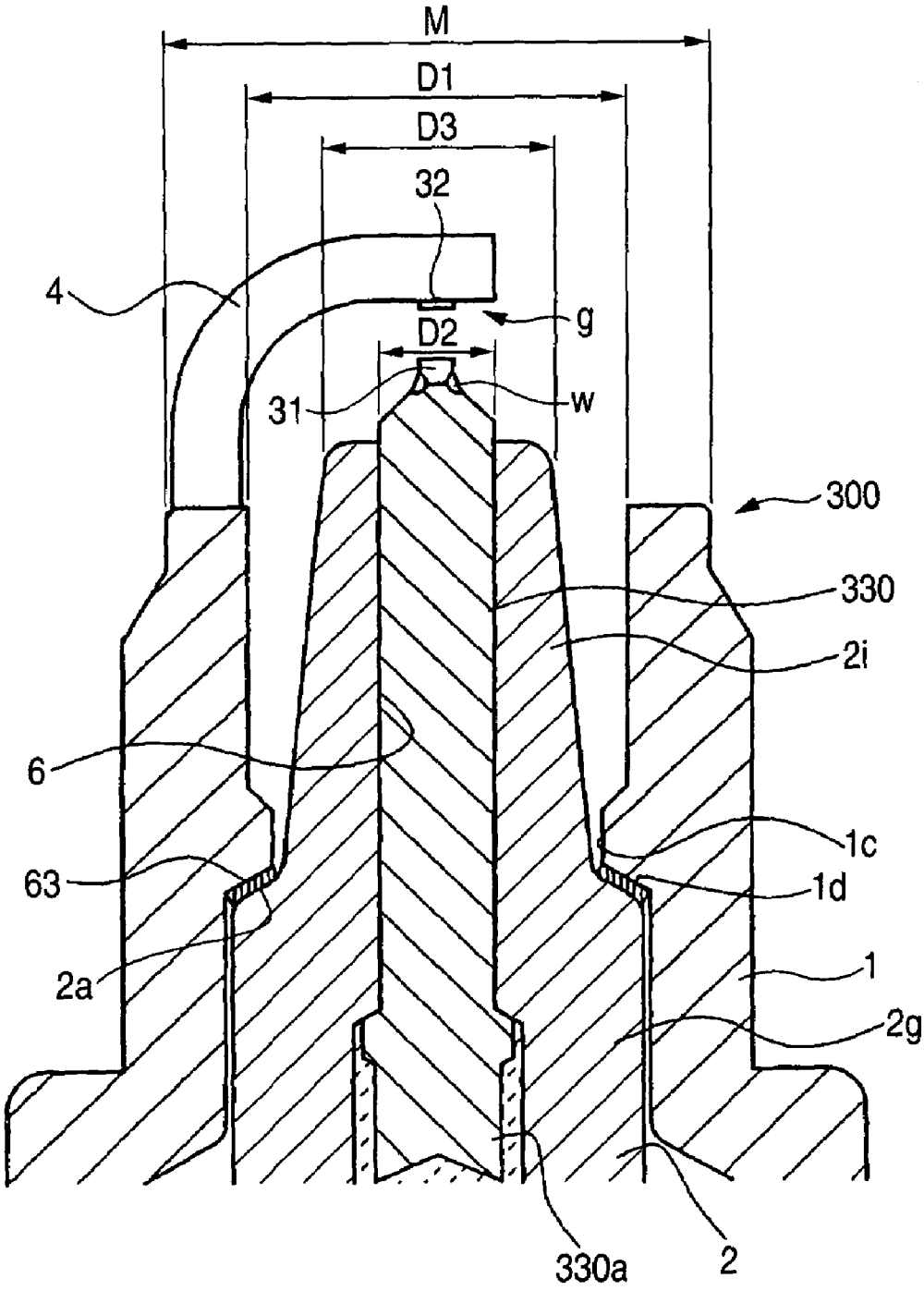
FIG. 2 is a front sectional view showing main portions of FIG. 1.

A resistor-containing spark plug 100 shown in FIGS. 1 and 2 is an example of the invention, and comprises: a cylindrical metal shell 1, an insulator 2 which is fitted into the metal shell 1 so that a tip end portion protrudes therefrom; a center electrode 3 which is disposed inside the insulator 2 while projecting a discharge portion 31; and a ground electrode 4 which is placed so as to oppose a side face of the sparking portion 31 (the center electrode 3). The ground electrode 4 is bent so that the tip end face opposes the side face of the discharge portion 31 in a substantially parallel manner, and a discharge portion 32 is formed opposed to the discharge portion 31. A gap between the discharge portions 31 and 32 forms spark gap g. By contrast, a rear end portion of the ground electrode 4 is fixed to and integrated with the metal shell 1 by welding or the like.

The metal shell 1 is made of carbon steel or the like. As shown in FIG. 1, a thread portion 12 for mounting the spark plug 100 to an engine block which is not shown is formed in the outer peripheral face of the metal shell. For example, the tip end outer diameter M of the thread portion is 6.5 (nominal thread size of M8) to 10.1 (nominal thread size of M12) mm. The metal shell has a projection 1*c* which circumferentially protrudes from the inner face, and a rear end step 1*d* trough which the projection 1*c* is connected to the inner face of the metal shell. The rear end step 1*d* engages step 2*a* of the insulator 2 which is formed between a front portion 2*i* of the insulator 2 and a rear portion 2*g* of the insulator 2, thereby fixing the insulator 2 to the metal shell 1 with a packing 63 disposed therebetween.

The center electrode 3 is configured by the discharge portion 31 and an electrode base member 3*a*. The electrode base member 3*a* is made of pure Ni or an Ni alloy containing 85 wt % or more of Ni, or specifically a 95-wt % Ni alloy. In the electrode base member 3*a* of the center electrode 3, the diameter of the tip end side is reduced, and the tip end face is flattened. A noble metal chip of a circular plate-like shape constituting the discharge portion 31 is placed on the tip end face, and a welded portion W is formed along the outer edge of the joining face to fix the chip by laser welding, electron beam welding, resistance welding, or the like, thereby forming the discharge portion 31. The discharge portion 32 is formed by positioning a similar chip on the ground electrode 4 and in a position corresponding to the discharge portion 31, and forming a similar welded portion W along the outer edge of the joining face to fix the chip. The discharge portions 31 and 32 are made of a metal primarily containing Pt Ir, and W. Specifically, Pt alloys such as Pt—Ir, Pt—Rh, and Pt—Rh—Ni, and Ir alloys such as Ir-5 wt % Pt, Ir-20Rh, Ir—Rh—Ni, Ir—Rh—Ni—Pt, Ir—Ru—Rh—Ni, and Ir—Rh—W are useful. Alternatively, the discharge portion 32 may be omitted. Herein, the term "discharge portion" means a portion of a joined chip which is not affected by variation in composition due to welding (for example, a portion excluding a portion in which the material is alloyed by welding with the material of the ground electrode or the center electrode). Since a noble metal chip is configured at the tip end of the center electrode and pure Ni or an Ni alloy containing 85 wt % or more of Ni is used as the electrode base member, the heat resistance of the center electrode is further ensured, and wear of the discharge portions is suppressed. Therefore, the outer diameter of the center electrode can be reduced as described below.

When the outer diameter of the center electrode in a virtual plane containing the tip end of the insulator is D2, the relationship 0.5 mm≦D2<1.4 mm is set. When D2 is set in this way, the relationship D1/D2≧3.5 which will be described below can easily be attained.

The insulator 2 is configured by a sintered body of ceramic such as alumina or aluminum nitride. A through hole 6 into which the center electrode 3 is to be fitted is formed inside the insulator along its axial direction O. A terminal post 13 is fitted and fixed to one end side of the through hole 6, and the center electrode 3 is similarly fitted and fixed to the other end side, In the through hole 6, a resistor 15 is placed between the terminal post 13 and the center electrode 3. The end portions of the resistor 15 are electrically connected to the center electrode 3 and the terminal post 13 via conductive glass seal layers 16, 17, respectively.

By contrast, when the inner diameter of the tip end face of the metal shell 1 is D1, and the outer diameter of the center electrode 3 in a virtual plane containing the tip end of the insulator 2 is D2, the relationship D1/D2≧3.5 is set. In the case of a spark plug in which the tip end outer diameter M of the metal shell 1 is 10.1 mm or smaller, the distance between the side face of the center electrode 3 and the inner face of the metal shell 1 is smaller than that of a conventional spark plug (a spark plug in which the tip end outer diameter M is larger than 10.1 mm), and hence side discharge possibly occurs between the center electrode 3 and the metal shell 1. Therefore, the spark plug 100 of the invention is structured so that, when the inner diameter of the tip end face of the metal shell 1 is D1, and the outer diameter of the center electrode 3 in a virtual plane containing the tip end of the insulator 2 is D2, the relationship D1/D2≧3.5 is attained. According to this configuration, the distance between the side face of the center electrode 3 and the inner face of the metal shell 1 can be sufficiently ensured, and side discharge between the center electrode 3 and the metal shell 1 can be suppressed.

When the outer diameter of the insulator in a virtual plane containing a tip end face of the metal shell is D3, the relationship D1/D3>1.8 is set. When the relationship D1/D3>1.8 is set as described above, the gap formed between the outer face of the insulator and the metal shell can be made larger, and side discharge between the center electrode and the metal shell can be further suppressed.

Embodiment 2

Next, Embodiment 2 of the invention will be described with reference to the accompanying drawings.

Figure 3:
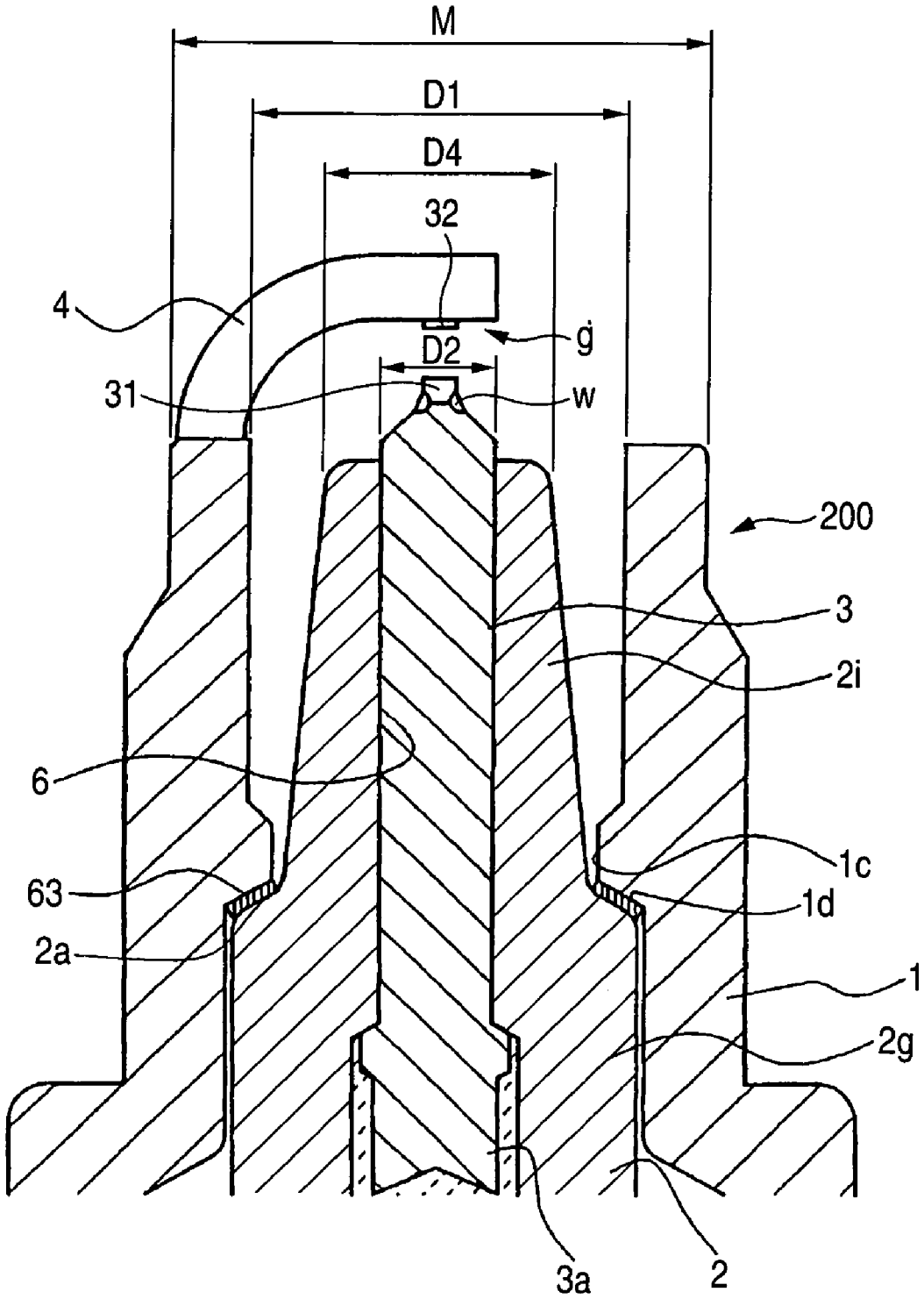
FIG. 3 is a front sectional view showing main portions of Embodiment 2.

A spark plug 200 shown in FIG. 3 has a structure in which the tip end of the insulator 2 of the above-described spark plug 100 is modified so as to protrude from the tip end of the metal shell 1, and the tip end of the insulator 2 is positioned on the rear end side with respect to the tip end of the metal shell 1. In FIG. 3, components identical with those of FIG. 2 are denoted by the same reference numerals. This embodiment is configured in the same manner as Embodiment 1 except for the above-described positional relationships. In the following description, therefore, the positional relationships between the insulator and the metal shell will mainly be discussed.

In the spark plug 200 of Embodiment 2, the tip end of the, insulator 2 is positioned on the rear end side with respect to the tip end of the metal shell 1, and, when the outer diameter of the tip end of the insulator 2 is D4, the relationship D1/D4>1.8 is set. When the relationship D1/D4>1.8 is set as described above, the gap formed between the outer face of the insulator and the metal shell can be made larger, and side discharge between the center electrode and the metal shell can be further suppressed. It is a matter of course that, when the inner diameter of the tip end of the metal shell is D1, and the outer diameter of the center electrode in a virtual plane containing the tip end of the insulator is D2, the relationships 0.5 mm≦D2<1.4 mm and D1/D2≧3.5 are set.

Embodiment 3

Next, Embodiment 3 of the invention will be described with reference to the accompanying drawings.

Figure 4:
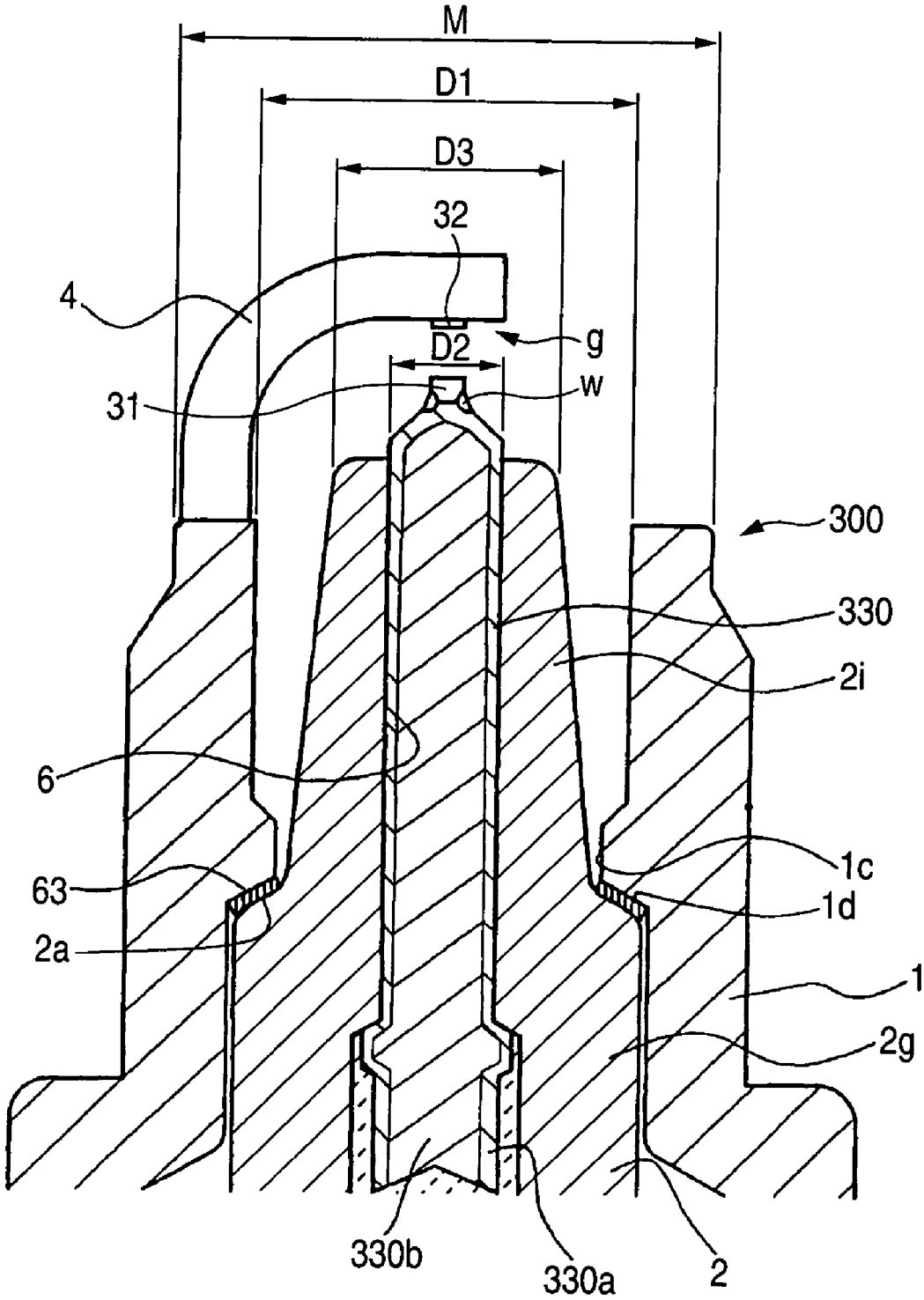
FIG. 4 is a front sectional view showing main portions of Embodiment 3.

A spark plug 300 shown in FIG. 4 has a structure in which the center electrode 3 of the above-described spark plug 100 is configured in a different manner. In FIG. 4, components identical with those of FIG. 2 are denoted by the same reference numerals. This embodiment is configured in the same manner as Embodiment 1 except for the above-described positional relationships. In the following description, therefore, the positional relationships between the insulator and the metal shell will mainly be discussed.

A center electrode 330 is configured by the discharge portion 31, a skin layer 330*a*, and a core 330*b*. The skin layer 330*a* is made of an Ni alloy, specifically, an Ni alloy such as INCONEL 600 (trademark of INCO Limited). At the tip end of the insulator, the skin layer has a thickness of 5 μm or more. A noble metal chip of a circular plate-like shape constituting the sparking portion 31 is placed on the tip end of the center electrode 3, and a welded portion W is formed along the outer edge of the joining face to fix the chip by laser welding, electron beam welding, resistance welding, or the like, thereby forming the discharge portion 31. The noble metal chip constituting the discharge portion 31 is made of any one of the materials which have been described above.

By contrast, the core 330*b* contains 90 wt % or more of a metal, the metal when pure having a thermal conductivity of 90 W·mK or more. Specifically, the core is made of an alloy such as a 98-wt % Cu alloy, pure NiL or the like. Since a noble metal chip is disposed in the tip end of the center electrode and the electrode base member is formed by a core disposed inside and containing 90 wt % or more of a metal, the metal when pure having a thermal conductivity of 90 W·mK or more; and a skin layer which surrounds the core, in which the film thickness at the tip end of the insulator is 5 to 20 μm and which is made of an Mi alloy, the heat resistance of the center electrode is ensured, and wear of the discharge portion is suppressed.

The center electrode 330 may be formed, in the same manner as the conventional art, by: first forming the skin layer 330*a* into a cup-like shape; inserting the core 330*b* into the recess of the cup-like shape; and then conducting an extrusion molding process or the like. Alternatively, the center electrode 330 may be formed by conducting an extrusion molding process or the like on a clad structure of the core 330*b* and the skin layer 330*a*.

Embodiment 4

Next, Embodiment 4 of the invention will be described with reference to the accompanying drawings.

Figure 5:
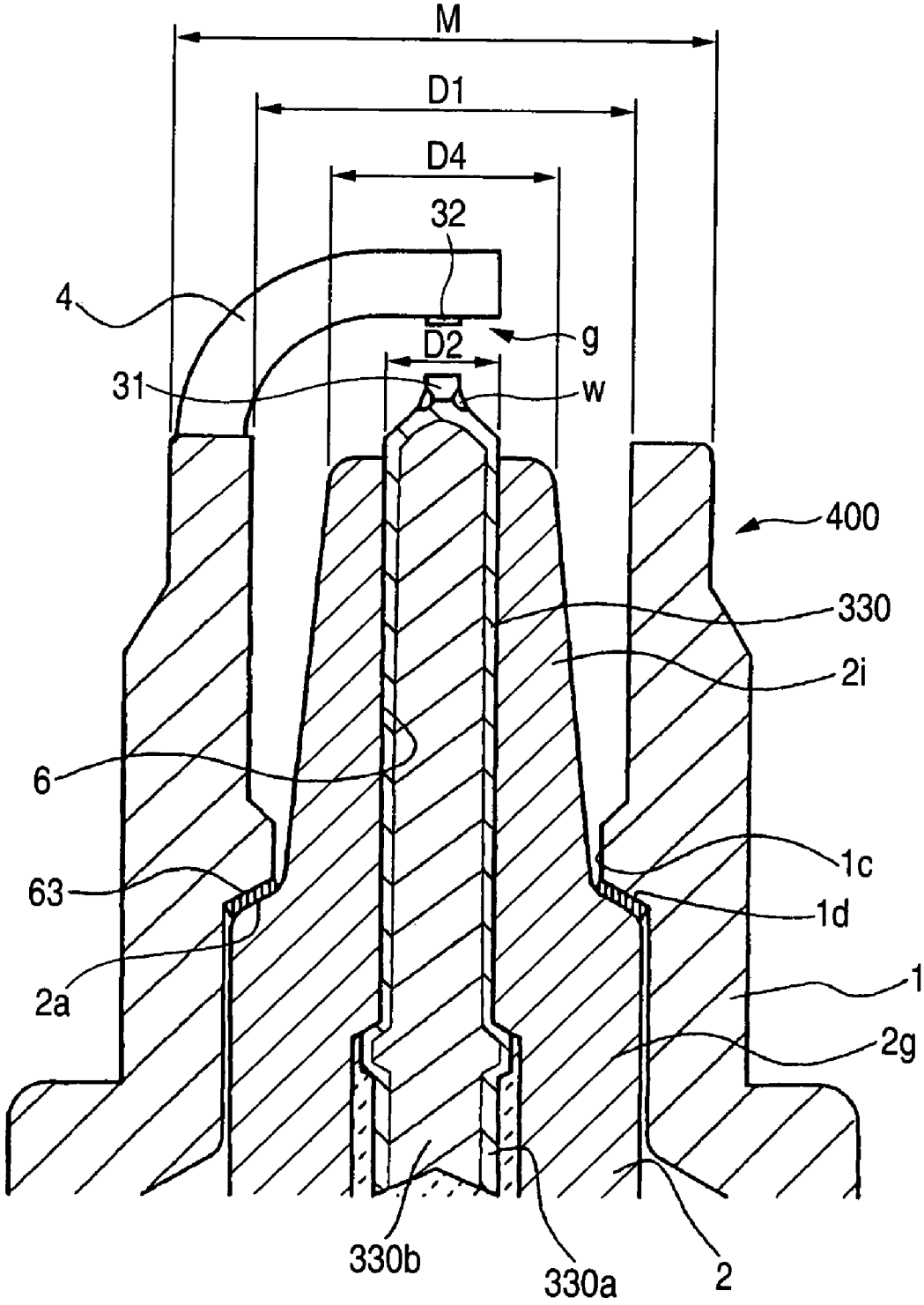
FIG. 5 is a front sectional view showing main portions of Embodiment 4.

A spark plug 400 shown in FIG. 5 has a structure in which the tip end of the insulator 2 is positioned on the rear end side with respect to the tip end of the metal shell 1, in place of the above-described structure in which the tip end of the insulator 2 of the spark plug 300 protrudes from the tip end of the metal shell 1. In FIG. 5, components identical with those of FIG. 4 are denoted by the same reference numerals. This embodiment is configured in the same manner as Embodiment 3 except for the above-described positional relationships. In the following description, therefore, the positional relationships between the insulator and the metal shell will mainly be discussed.

In the spark plug 400 of Embodiment 4, the tip end of the insulator 2 is positioned on the rear end side with respect to the tip end of the metal shell 1, and, when the outer diameter of the tip end of the insulator 2 is D4, the relationship D1/D4>1.8 is set. When the relationship D1/D4>1.8 is set as described above, the gap formed between the insulator and the metal shell can be made larger, and side discharge between the center electrode and the metal shell can be further suppressed. It is a matter of course that, when the inner diameter of the tip end of the metal shell is D1, and the outer diameter of the center electrode in a virtual plane containing the tip end of the insulator is D2, the relationships 0.5 mm≦D2<1.4 mm and D1/D2≧3.5 are set.

Figure 6:
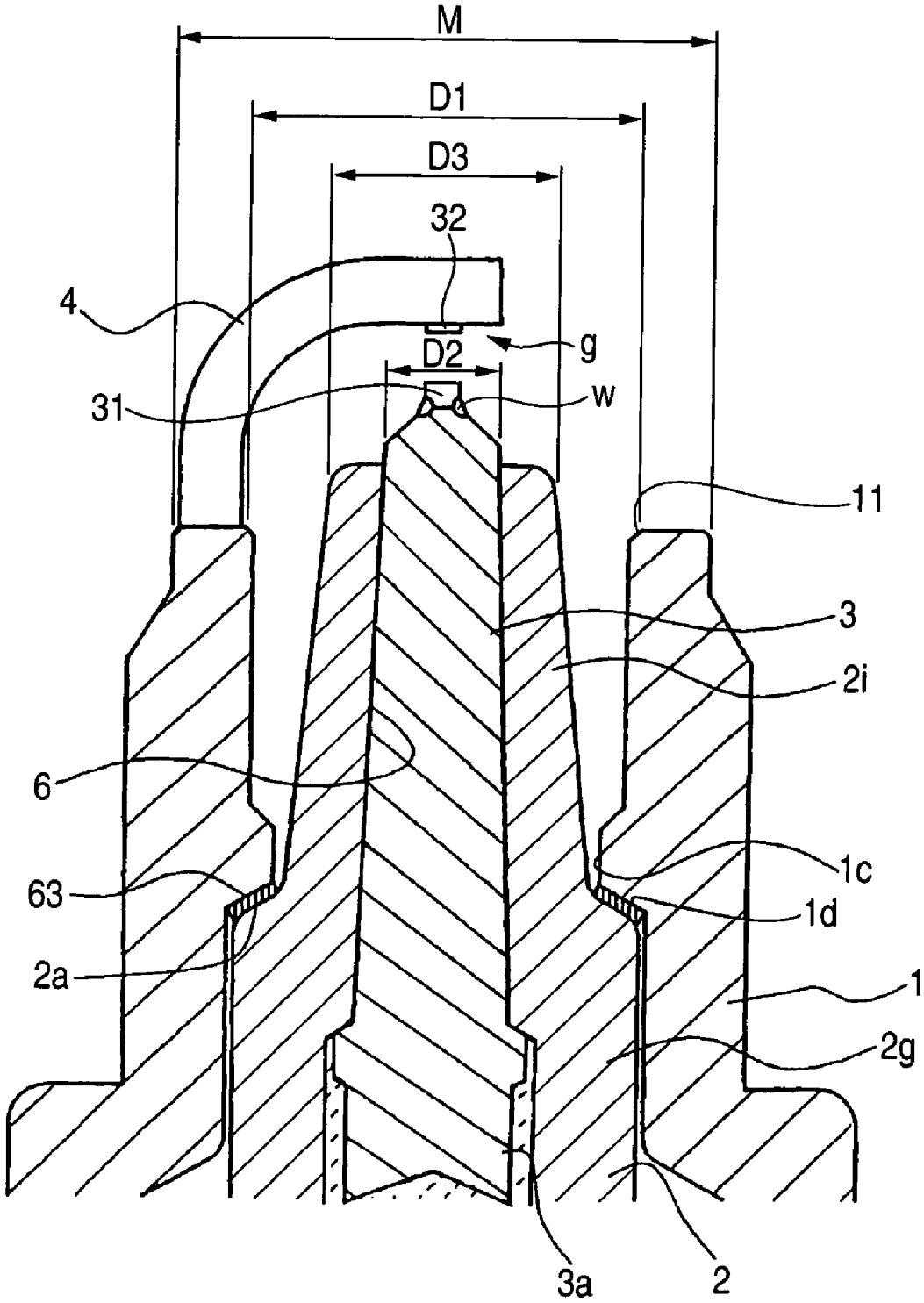
FIG. 6 is a front sectional view showing main portions of an embodiment of the spark plug in which a basal portion is thicker than a tip end portion.

In the center electrode 3 or 330, the diameter of a basal portion may be larger than that of the tip end side portion. According to this configuration, the heat dissipation property of the center electrode can be improved, and the wear resistance of the discharge portions can be further enhanced. In FIG. 6, the outer peripheral face of the center electrode 3 is formed into a tapered shape, so that the diameter of a basal portion of the electrode is larger than that of the tip end side portion. Alternatively, a step may be formed in the outer peripheral face, so that a large-diameter basal portion in which the diameter is substantially uniform, and a small-diameter tip end portion are formed. Although FIG. 6 shows the center electrode 3, the center electrode 330 can also be configured in the same manner.

In FIG. 6, a chamfered portion 11 is formed in the inner face of the tip end of the metal shell. By forming chamfered portion 11, the distance between the outer diameter D2 of the center electrode 3 and the inner diameter D1 of the tip end face of the metal shell 1 is increased, so that side discharge can be flintier suppressed.

EXAMPLES

Example 1

In order to ascertain the effects of the invention, the following various experiments were conducted.

Various samples of spark plugs having the structures shown in FIGS. 2 and 4 were prepared in the following manner. First, sintered alumina ceramic was selected as the material of the insulator 2, a Ni—80 wt % Ni alloy, a Ni—85 wt % Ni alloy, or a Ni—95 wt % Ni alloy as the electrode base member of the center electrode 3, a core of a 98 wt % Cu alloy and a skin layer of a 95 wt % Ni alloy as the center electrode 330, and Ir—5 wt % Pt as the material of the noble metal chips for forming the discharge portions 31, 32. Each of the noble metal chips had a columnar shape having a height of 0.4 mm and a diameter of 0.6 mm. The dimensions shown in FIG. 2 were set as follows, M: 8.45 mm (corresponding to nominal thread size of M10), D1: 6 mm, D3: 4.2 mm, and g: 0.9 mm. As comparative examples, spark plugs were produced in which INCONEL 600 (a Ni—Cr—Fe alloy having a Ni content of about 72 wt %) was used as the material of the center electrode, and the material of the insulator and the material and dimensions of the noble metal chip were set as described above. The film thickness of the skin layer at the tip end of the insulator was 300 μm.

Spark plugs in which the dimension D2 in FIG. 2 was set as listed in Table 1 were mounted on a six-cylinder DOHC gasoline engine having a 2,000 cc displacement. The engine was continuously operated at 5,600 rpm in a wide-open-throttle condition for 50 hours. After the operation, the gap increment was measured. The results are shown in Table 1. Samples in which the gap increment was smaller than 0.1 mm were evaluated as ◎, and those in which the gap increment was equal to or larger than 0.1 mm and smaller than 0.3 mm were evaluated as ○. Samples of ◎ and ○ were judged acceptable. Samples in which the gap increment was equal to or larger than 0.3 mm and smaller than 0.4 mm were evaluated as Δ. Samples in which the gap increment was equal to or larger than 0.4 mm were evaluated as X and judged unacceptable. The results are shown in Table 1.

TABLE 1

| Sample | Material of center electrode | D2 (mm) | Evaluation |
|---|---|---|---|
| 1 | INCO600 | 1.5 | ○ |
| 2 | INCO600 | 1.0 | X |
| 3 | 80 wt % Ni alloy | 1.0 | X |
| 4 | 85 wt % Ni alloy | 1.0 | ○ |
| 5 | 95 wt % Ni alloy | 1.5 | ◎ |
| 6 | 95 wt % Ni alloy | 1.0 | ○ |
| 7 | Skin layer of 95 wt % Ni alloy + core of 98 wt % Cu alloy | 1.5 | ◎ |
| 8 | Skin layer of 95 wt % Ni alloy + core of 98 wt % Cu alloy | 1.0 | ◎ |

A seen from Table 1, in the spark plugs (Samples 1, 5, 7) in which the center electrode had a diameter of 1.5 mm, the gap increment was smaller than 0.3 mm. By contrast, in the case where the diameter of the center electrode is reduced (the diameter of the center electrode is 1.0 mm), in the spark plug (Sample 2) using the center electrode in which the electrode base member is formed by INCO 600, and the spark plug (Sample 3) in which the electrode base member is made of an 80 wt % Ni alloy, the gap increment was equal to or larger than 0.5 mm. In the spark plug (Sample 4) in which the electrode base member is made of an 85 wt % Ni alloy, the spark plug (Sample 6) in which the electrode base member is made of a 95 wt % Ni alloy, and the spark plug (Sample 8) using the center electrode in which the electrode base member is formed by: the core disposed inside and containing 90 wt % or more of a metal (in the examples, Cu), the metal when pure having a thermal conductivity of 90 W·mK or more; and the skin layer which surrounds the core, in which the film thickness at the tip end of the insulator is 5 μm or more, and which is made of an Ni alloy, the gap increment was smaller than 0.3 mm, or wear of the discharge portions was suppressed. Namely, the heat resistance of the center electrode is ensured, and wear of the discharge portions is suppressed by employing: the configuration where a center electrode is configured by an electrode base member made of an Ni alloy containing 85 wt % or more of Ni, and a noble metal chip fixed to the tip end of the electrode base member; or where the center electrode is configured by: an electrode base member formed by a core disposed inside and containing 90 wt % or more of a metal, the metal when pure having a thermal conductivity of 90 W·mK or more, and a skin layer which surrounds the core, in which the film thickness at the tip end of an insulator is 5 μm or more, and which is made of an Ni alloy; and a noble metal chip fixed to the tip end of the electrode base member.

Example 2

Next various samples of the spark plugs having the structures shown in FIGS. 2 and 4 were prepared in the following manner. Sintered alumina ceramic was selected as the material of the insulator 2, a Ni—95 wt % Ni alloy as the electrode base member of the center electrode 3 (Samples 9 to 12), a core of a 98 wt % Cu alloy and a skin layer made of INCONFL 600 as the center electrode 330 (Samples 13 to 16), and Ir—5 wt % Pt as the material of the noble metal chips for forming the discharge portions 31, 32. The dimensions shown in FIG. 2 were set as follows, M: 8.45 mm, D3: 4.2 mm, and g: 0.9 mm. The dimensions D1 and D2 were set as listed in Table 2 below.

The samples were mounted for testing on a six-cylinder DOHC gasoline engine having a 2,000 cc displacement. The engine was operated at 700 rpm in an idling condition. The waveform of a discharge spark was measured using a reference plug in which the ground electrode 4 is removed. In a test using a sample plug, when a waveform identical with that in the case of the reference plug was produced, it was judged that "side discharge" occurred. Among 1,000 measurements, measurements in which the waveform was produced were counted to check the side discharge occurrence rate. Samples in which the side discharge occurrence rate was equal to or larger than 0 and smaller than 10% were evaluated as ○, those in which the side discharge occurrence rate was equal to or larger than 10% and smaller than 25% were evaluated as Δ, and those in which the side discharge occurrence rate was equal to or larger than 25% were evaluated as X. The results are shown in Table 2.

TABLE 2

| Sample | D2 | D1 | D1/D2 | Side Discharge |
|---|---|---|---|---|
| 9 | 2.45 | 6 | 2.45 | X |
| 10 | 1.40 | 6 | 4.29 | Δ |
| 11 | 1.00 | 6 | 6.00 | ○ |
| 12 | 0.60 | 6 | 10.00 | ○ |
| 13 | 2.45 | 6 | 2.45 | X |
| 14 | 1.40 | 6 | 4.29 | Δ |
| 15 | 1.00 | 6 | 6.00 | ○ |
| 16 | 0.60 | 6 | 10.00 | ○ |

In Samples 9, 13, side discharge occurred at a rate of 25% or more, but, in Samples 10, 11, 12, 14, 15, 16, the side discharge rate was smaller than 25%. In Samples 11, 12, 15, 16, futhermore, the side discharge rate was smaller than 10% . Namely, when the relationship D1/D2≧3.5 is set, the distance between the side face of the center electrode and the inner face of the metal shell can be sufficiently ensured, and side discharge between the center electrode and the metal shell can be suppressed. When D1/D2≧5.0 is set, side discharge can be suppressed more effectively.

Example 3

Next, various samples of the spark plugs having the structures shown in FIGS. 2 and 4 were prepared in the following manner. An insulator and a center electrode which are made of the same materials as those of Embodiment 2 were selected, and the dimensions shown in FIG. 2 were set as follows, M: 8.45 mm, D2: 1.0 mm, and g: 0.9 mm. The dimensions D1 and D3 were set as listed in Table 3 below.

In the same manner as described above, the samples were mounted for testing on a six-cylinder DOHC gasoline engine having a 2,000 cc displacement. The engine was operated at 700 rpm in an idling condition, The waveform of a side spark was measured using a reference plug in which the ground electrode 4 is removed. In a test using a sample plug, when a waveform identical with that in the case of the reference plug was produced, it was judged that "side discharge" occurred. Among 1,000 measurements, measurements in which the waveform was produced were counted to check the side discharge occurrence rate. A Ni—95 wt % Ni alloy was used as the electrode base member of the center electrode 3 (Samples 17 to 20), or a core of a 98 wt % Cu alloy and a skin layer made of ICON 600 was used as the center electrode 330 (Samples 21 to 24). Samples in which the side discharge occurrence rate was equal to or larger than 0 and smaller than 10% were evaluated as ○, those in which the side discharge rate was equal to or larger than 10% and smaller than 25% were evaluated as Δ, and those in which the side discharge rate was equal to or larger than 25% were evaluated as X. The results are shown in Table 3.

The samples were mounted for testing on a four-cylinder DOHC gasoline engine having a 2,000 cc displacement, and a soot fouling test was conducted in accordance with JIS D1606 (2001). The predetermined running pattern specified in JIS D1606 was set as one cycle. For each of the samples, cycles were counted until the insulation resistance was reduced to 10 MΩ. Samples in which the counted cycle number was 8 or more were evaluated as ○, those in which the counted cycle number was 5 to 7 were evaluated as Δ, and those in which the counted cycle number was smaller than 5 were evaluated as X. The results are shown in Table 3.

TABLE 3

| Sample | D1 | D3 | D1/D3 | Side Discharge | Contamination resistance |
|---|---|---|---|---|---|
| 17 | 6 | 4.2 | 1.43 | X | ○ |
| 18 | 6 | 3.3 | 1.82 | Δ | ○ |
| 19 | 6 | 2.7 | 2.22 | ○ | ○ |
| 20 | 6 | 1.8 | 3.33 | ○ | X |
| 21 | 6 | 4.2 | 1.43 | X | ○ |
| 22 | 6 | 3.3 | 1.82 | Δ | ○ |
| 23 | 6 | 2.7 | 2.22 | ○ | ○ |
| 24 | 6 | 1.8 | 3.33 | ○ | X |

In Samples 17, 21, side discharge occurred at a rate of 25% or more, but, in Samples 18, 19, 20, 22, 23, 24, the side discharge rate was smaller than 25%. In Samples 19, 20, 23, 24, furthermore, the side discharge rate was smaller than 10% . Namely, when the relationship D1/D3>1.8 is set, the gas volume defined by the outer face of the insulator and the metal shell can be increased, and side discharge can be further suppressed. When the relationship D1/D3>2.0 is set, side discharge can be suppressed more effectively.

In Samples 17, 18, 19, 21, 22, 23, the counted cycle number was smaller than 5. By contrast, in Samples 20, 24, the counted cycle number was 5 or more. Namely, when the relationship D3≧D2+0.1 mm is set, the contamination resistance of the insulator is improved.

The invention is not restricted to the above-described specific embodiments, and may be realized in embodiments which are variously modified in accordance with the purpose and use within the scope of the invention. In the spark plug 100 of the invention, for example, the welded portion W to be welded to the center electrode 3 is formed along the outer edge of the joining face as shown in FIG. 2. The invention is not restricted to this configuration. The welded portion may be continuously formed in a radial direction of a noble metal chip. According to this configuration, the noble metal chip can be welded more firmly to the center electrode 3.

In the spark plug 100 of the invention, a single ground electrode 4 is shown. Alternatively, a plurality of ground electrodes may be disposed. According to this configuration, the ignitability of the spark plug is improved.

The center electrode 3 of the spark plug 100 of the invention has a tapered face in which the diameter is progressively reduced toward its tip end, which projects from the tip end face of the insulator, and the tip end is formed into a shape having a small diameter. The invention is not restricted to this configuration. The center electrode may have a tapered face in which the diameter is progressively reduced as it advances from a rear end side with respect to the tip end face of the insulator, toward the tip end of the center electrode.

This application is based on Japanese Patent application JP 2003-319904, filed Sep. 11, 2003, the entire content of which is hereby incorporated by reference, the same as if set forth at length.

What is claimed is:

1. A spark plug comprising:

an insulator having an axial hole in an axial direction of the spark plug;

a center electrode disposed in a tip end side of the axial hole of said insulator so as to project a tip end of said center electrode from said tip end side of the insulator, said center electrode including: an electrode base member made of pure Ni or an Ni alloy containing 85 wt% or more of Ni; and a noble metal chip fixed to a tip end of said electrode base member;

a metal shell surrounding said insulator; and a ground electrode in which one end is joined to said metal shell, and another end portion opposes said noble metal chip to form a spark discharge gap between said ground electrode and said noble metal chip, wherein when an outer diameter of a tip end of said metal shell is M, an inner diameter of said tip end of said metal shell is D1, and an outer diameter of said center electrode in a virtual plane containing a tip end of said insulator is D2, the following relationships are satisfied:

$$M \leqq 10.1 \text{ mm},$$

$$0.5 \text{ mm} \leqq D2 < 1.4 \text{ mm, and}$$

$$D1/D2 \geqq 3.5.$$

2. A spark plug comprising:

an insulator having an axial hole in an axial direction of the spark plug;

a center electrode disposed in a tip end side of said axial hole of said insulator so as to project a tip end of said center electrode from said tip end side of the insulator, said center electrode including: an electrode base member; and a noble metal chip fixed to a tip end of said electrode base member;

a metal shell surrounding said insulator; and a ground electrode in which one end is joined to said metal shell, and another end portion opposes said noble metal chip to form a spark discharge gap between said ground electrode and said noble metal chip, wherein said electrode base member includes: a core disposed inside said electrode base member, said core containing 90 wt% or more of a metal, the metal when pure having a thermal conductivity of 90 W·mK or more; and a skin layer which surrounds said core, and wherein a thickness of said skin layer at a tip end of said insulator is 5 μm or more, said skin layer being made of pure Ni or an Ni alloy having a thermal conductivity lower than that of said core, and when an outer diameter of a tip end of said metal shell is M, an inner diameter of said tip end of said metal shell is D1, and an outer diameter of said center electrode in a virtual plane containing said tip end of said insulator is D2, the following relationships are satisfied:

$M \leqq 10.1$ mm, $0.5 \text{ mm} \leqq D2 < 1.4$ mm, and $D1/D2 \geqq 3.5$.

3. The spark plug as claimed in claim 1, wherein said tip end of said insulator protrudes from the tip end of said metal shell, or is positioned in a virtual plane containing the tip end of said metal shell, and when an outer diameter of said insulator in a virtual plane containing a tip end face of said metal shell is D3, the following relationships are satisfied:

$D1/D3 > 1.8$, and $D3 \geqq D2 + 0.1$ mm.

4. The spark plug as claimed in claim 2, wherein said tip end of said insulator protrudes from the tip end of said metal shell, or is positioned in a virtual plane containing the tip end of said metal shell, and when an outer diameter of said insulator in a virtual plane containing a tip end face of said metal shell is D3, the following relationships are satisfied:

$D1/D3 > 1.8$, and $D3 \geqq D2 + 0.1$ mm.

5. The spark plug as claimed in claim 1, wherein said tip end of said insulator is positioned on a rear end side with respect to the tip end of said metal shell, and when an outer diameter of the tip end of said insulator is D4, the following relationships are satisfied:

$D1/D4 > 1.8$, and $D4 \geqq D2 + 0.1$ mm.

6. The spark plug as claimed in claim 2, wherein said tip end of said insulator is positioned on a rear end side with respect to the tip end of said metal shell, and when an outer diameter of the tip end of said insulator is D4, the following relationships are satisfied:

$D1/D4 > 1.8$, and $D4 \geqq D2 + 0.1$ mm.

7. The spark plug as claimed in claim 1, wherein said noble metal chip primarily contains one of Ir and Pt.

8. The spark plug as claimed in claim 2, wherein said noble metal chip primarily contains one of Ir and Pt.

9. The spark plug as claimed in claim 1, wherein said noble metal chip comprises an Ir alloy which mainly contains Ir, and further contains at least one selected from the group consisting of Pt, Rh, Ni, Ru, Pd, W and Re.

10. The spark plug as claimed in claim 2, wherein said noble metal chip comprises an Jr alloy which mainly contains Ir, and further contains at least one selected from the group consisting of Pt, Rh, Ni, Ru, Pd, W and Re.

11. The spark plug as claimed in claim 9, wherein said noble metal chip further contains at least one selected from the group consisting of an oxide, a carbide, a nitride, and a boride of at least one element selected from Y, Zr and La.

12. The spark plug as claimed in claim 10, wherein said noble metal chip further contains at least one of an oxide, a carbide, a nitride and a boride of at least one element selected from the group consisting of Y, Zr and La.

13. The spark plug as claimed in claim 1, comprising a chamfer formed on an inner peripheral edge of the tip end of said metal shell.

14. The spark plug as claimed in claim 2, comprising a chamfer formed on an inner peripheral edge of the tip end of said metal shell.

15. The spark plug as claimed in claim 2, wherein a minimum distance in an axial direction between the core of said electrode base member and said noble metal chip is 2 mm or less.

16. The spark plug as claimed in claim 1, wherein $D1/D2 \geqq 5$.

17. The spark plug as claimed in claim 2, wherein $D1/D2 \geqq 5$.

18. The spark plug as claimed in claim 3, wherein $D1/D3 > 2$.

19. The spark plug as claimed in claim 4, wherein $D1/D3 > 2$.

20. The spark plug as claimed in claim 2, wherein the thickness of said skin layer is 5 to 500 μm.

* * * * *